US009271582B1

(12) United States Patent
Pando

(10) Patent No.: US 9,271,582 B1
(45) Date of Patent: Mar. 1, 2016

(54) STACKABLE OBJECT DISPENSER

(71) Applicant: Richard Pando, La Mirada, CA (US)

(72) Inventor: Richard Pando, La Mirada, CA (US)

( * ) Notice: Subject to any disclaimer, the term of this patent is extended or adjusted under 35 U.S.C. 154(b) by 198 days.

(21) Appl. No.: 13/841,043

(22) Filed: Mar. 15, 2013

(51) Int. Cl.
*A47F 1/08* (2006.01)

(52) U.S. Cl.
CPC ..... *A47F 1/085* (2013.01)

(58) Field of Classification Search
USPC ..... 221/33, 34, 36, 56, 123, 194, 208, 221, 221/223, 226, 268
See application file for complete search history.

(56) References Cited

U.S. PATENT DOCUMENTS

| | | | | |
|---|---|---|---|---|
| 4,243,153 | A * | 1/1981 | Mitchell | 221/34 |
| 4,436,222 | A * | 3/1984 | Taylor et al. | 221/223 |
| 4,502,499 | A * | 3/1985 | Behr | 453/49 |
| 5,131,562 | A | 7/1992 | Brown | |
| 5,819,982 | A | 10/1998 | Brown | |
| 5,918,765 | A * | 7/1999 | Blankenship et al. | 221/221 |
| 5,975,839 | A * | 11/1999 | Ashby | 414/798.1 |
| 6,357,624 | B1 | 3/2002 | Brown | |
| 6,832,698 | B1 | 12/2004 | Dybul | |
| 7,337,919 | B2 | 3/2008 | Walsh | |
| 7,673,773 | B1 | 3/2010 | Walsh | |
| 7,900,797 | B1 | 3/2011 | Witcraft | |
| 8,025,181 | B1 | 9/2011 | Horn | |
| 2001/0038017 | A1* | 11/2001 | Davis | 221/188 |
| 2002/0190076 | A1* | 12/2002 | Thompson | 221/221 |
| 2005/0092767 | A1 | 5/2005 | Schroeder | |
| 2006/0157493 | A1* | 7/2006 | Christoffersen et al. | 221/36 |
| 2007/0151982 | A1* | 7/2007 | Walsh et al. | 221/171 |
| 2011/0101017 | A1 | 5/2011 | Schroeder | |

* cited by examiner

*Primary Examiner* — Gene Crawford
*Assistant Examiner* — Kelvin L Randall, Jr.
(74) *Attorney, Agent, or Firm* — Neustel Law Offices

(57) ABSTRACT

A stackable object dispenser for selectively and sanitarily dispensing an individual object from a plurality of stacked objects. The stackable object dispenser generally includes a base and a plate member secured to an upper end thereof. The plate member includes an opening over which is positioned a retention member for retaining a stack of objects. Portions of dispensing retainers abut into the opening to prevent any of the objects from prematurely being dispensed. Upon activation of an external lever or knob, a dispensing assembly acts to push a pair of dispensing members inwardly to squeeze and push down the lowest object in the stack to be dispensed into a cavity and retrieved through a frontal opening of the base.

3 Claims, 7 Drawing Sheets

STACKABLE OBJECT DISPENSER

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an object dispenser and more specifically it relates to a stackable object dispenser for selectively and sanitarily dispensing an individual object from a plurality of stacked objects.

2. Description of the Related Art

Any discussion of the related art throughout the specification should in no way be considered as an admission that such related art is widely known or forms part of common general knowledge in the field.

Stackable objects such as lids and cups are dispensed daily in restaurants, coffeeshops and stores throughout the world. Generally, these objects are stacked in a retainer which requires an individual to reach his/her hand into the stack to retrieve the object. Certain stacked objects are often difficult to separate from each other, which often results in an individual inadvertently grabbing two or more of the objects from the stack. Additionally, other individuals retrieving objects from the stack at a later time may be exposed to germs from previous individuals who grasped those objects when retrieving their own.

Because of the inherent problems with the related art, there is a need for a new and improved stackable object dispenser for selectively and sanitarily dispensing an individual object from a plurality of stacked objects.

BRIEF SUMMARY OF THE INVENTION

The invention generally relates to an object dispensing device which includes a base and a plate member secured to an upper end thereof. The plate member includes an opening over which is positioned a retention member for retaining a stack of objects. Portions of dispensing retainers abut into the opening to prevent any of the objects from prematurely being dispensed. Upon activation of an external lever or knob, a dispensing assembly acts to push a pair of dispensing members inwardly to squeeze and push down the lowest object in the stack to be dispensed into a cavity and retrieved through a frontal opening of the base.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
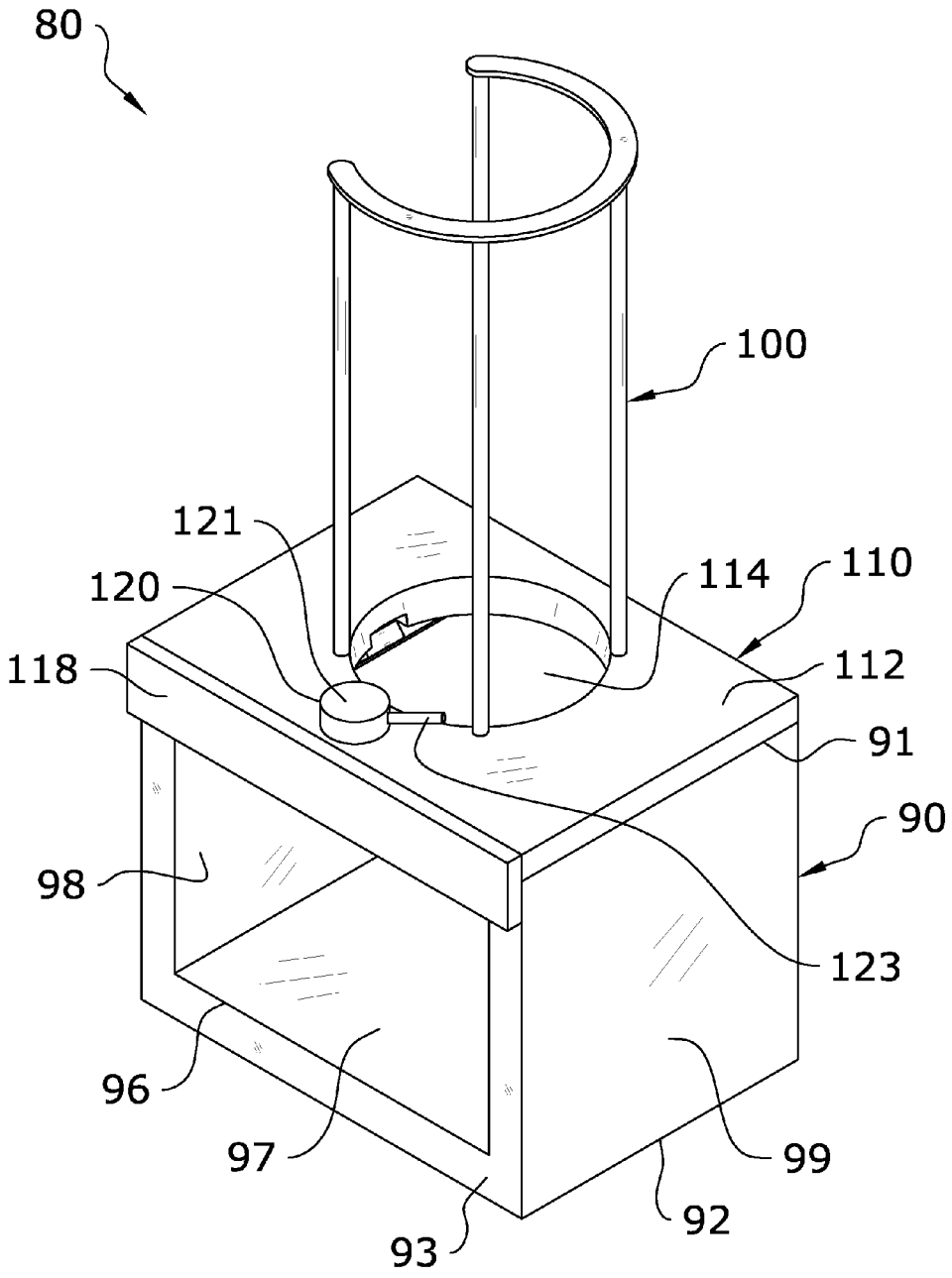
FIG. 1 is an upper perspective view of a main embodiment of the present invention.

A. Overview.

Turning now descriptively to the drawings, in which similar reference characters denote similar elements throughout the several views, FIGS. 1 through 7 illustrate a main embodiment of a stackable object dispenser 80, which comprises a base 90 and a plate member 110 secured to an upper end 91 thereof. The plate member 110 includes an opening 114 over which is positioned a retention member 100 for retaining a stack of objects 86. Portions of dispensing retainers 153, 158 abut into the opening 114 to prevent any of the objects 86 from prematurely being dispensed. Upon activation of an external lever or knob 120, a dispensing assembly acts to push a pair of dispensing members 150, 155 inwardly to squeeze and push down the lowest object 86 in the stack to be dispensed into a cavity 97 and retrieved through a frontal opening 96 of the base 90.

B. Base.

The present invention generally includes a base 90 which supports the various components of the present invention. The base 90 may be comprised of various shapes, sizes and configurations, and thus should not be construed as being limited by the exemplary figures. It is appreciated that the base 90 may be integrally formed of a unitary structure or, in some embodiments, may be comprised of various structures secured to each other to form the base 90.

In a preferred embodiment of the present invention as shown in FIG. 1, the base 90 is comprised of a substantially cube-shaped housing having an upper end 91, a lower end 92 and a front end 93. The front end 93 of the base 90 includes a frontal opening 96 leading to a cavity 97 in which dispensed objects 86 may be retrieved after being dispensed. The cavity 97 is defined by at least a first sidewall 98 and a second sidewall 99. The rear of the base 90 may be wholly or partially opening in some embodiments, or may be entirely enclosed off in others.

C. Retention Member.

The present invention includes a retention member 100 which acts to retain the stacked objects 86 therein prior to being dispensed one-by-one. The retention member 100 generally extends upwardly from the upper end 112 of the plate member 110 as shown in FIG. 1. The retention member 100 is positioned directly above the upper opening 114 of the plate member 110 so as to allow objects 86 retained therein to freely pass through the upper opening 114 and gravitate into the cavity 97 after dispensing by the dispensing members 150, 155.

Various types of retention members 100 may be utilized with the present invention. The figures merely illustrate one example of a retainer member 100 used with the present invention. The scope of the present invention should not be limited by the exemplary illustration. Any structure capable of stacking objects 86 such as cups or lids may be utilized for the retainer member 100 so long as it is properly positioned on the upper end 112 of the plate member 110 over the upper opening 114 as shown in the figures.

As best shown in FIGS. 4-7, the retention member 100 may also be utilized in combination with a stabilizer member 102, 104 which acts to stabilize the stacked objects 86 within the retention member 100. The figures illustrate a first stabilizer member 102 being adapted for use with cups 86 and a second stabilizer member 104 being adapted for use with lids 86.

The first stabilizer member 102, which is preferably adapted to stabilize a stack of cups 86 within the retention member 100, is generally comprised of a disc-shaped structure with a downwardly-extending central portion which creates a lower rim. The diameter of the disc of the first stabilizer member 102 is preferably slightly smaller than the diameter of the retention member 100 as shown in the figures. The first stabilizer member 102 is positioned over the top cup 86 in the stack of objects 86, with its lower rim being positioned adjacent the inner rim of the cup 86 opening to stabilize the cup 86 as it descends the retention member 100.

The second stabilizer member 104, which is preferably adapted to stabilize a stack of lids 86 within the retention member 100, is generally comprised of a ring-like structure, wherein the ring has a diameter which is slightly smaller than that of the retention member 100 as shown in the figures. The second stabilizer member 104 is positioned over the top lid 86 in the stack of objects 86 such that its ring encircles the raised upper portion of the lid 86 to stabilize the lid 86 as it descends the retention member 100.

D. Plate Member.

The plate member 110 of the present invention is positioned over the upper end 91 of the base 90 as shown in FIG. 1. In some embodiments of the present invention, the plate member 110 may be integrally formed with the base 90. In other embodiments such as shown herein, the plate member 110 may be comprised of a discrete structure.

The plate member 110 is generally comprised of a substantially rectangular or square-shaped plate which extends between the two sidewalls 98, 99 at their upper ends as shown in the figures. The plate member 110 generally encloses the cavity 97 of the base 90, which is defined by the base's 90 lower end 92, sidewalls 98, 99 and the plate member 110.

The plate member 110 includes an upper end 112 and a lower end 113. The retention member 100 of the present invention extends upwardly from the upper end 112 of the plate member 110 in a position surrounding an opening 114 which extends through the plate member 110. Objects 86 such as lids and/or cups are dispensed through this opening 114 as shown in the figures. Various other apertures 82 extend fully or partially through the plate member 110 for securing various components of the present invention thereto with fasteners 84.

The lower end 113 of the plate member 110 supports the dispensing assembly of the present invention. The lower end 113 will generally include a pair of slots 115, 116 positioned adjacent the opening 114. Preferably, a first slot 115 will extend outward from a first point on the outer circumference of the opening 114 and a second slot 116 will extend outward in an opposite direction from a second point in the outer circumference of the opening 114, the first point being 180 degrees from the second point.

Figure 2:
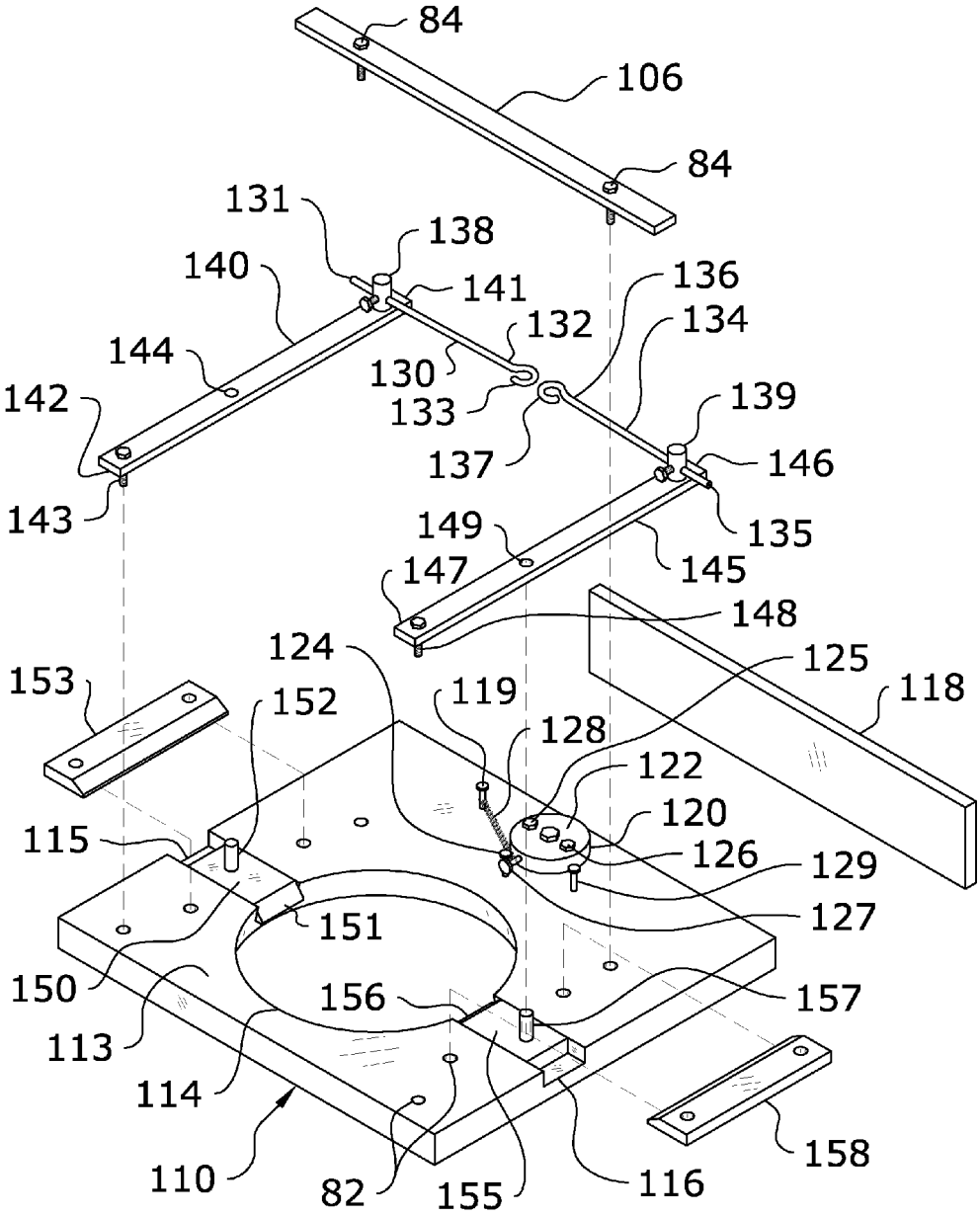
FIG. 2 is an exploded upper perspective view of a main embodiment of the present invention.

More specifically, the first slot 115 extends from a first edge of the plate member 110 to the first point on the opening 114 and the second slot 116 extends from a second edge of the plate member 110 to the second point on the opening 114 as shown in FIG. 2. The slots 115, 116 are utilized to support and guide the dispensing members 150, 155, which are slidably positioned therein.

A spring mount 119 may also be included on the lower end 113 of the plate member 110. The spring mount 119 is comprised of a structure to which one of the ends of the spring 128 of the present invention will be anchored.

The plate member 110 further includes a knob aperture 117, comprised of an opening through which the knob 120 of the present invention will be positioned as shown in FIGS. 1 and 2. A front guard 118 may also be provided to secure and conceal the dispensing assembly components under the plate member 110. In some embodiments, the front guard 118 may be integrally formed of a unitary structure with the plate member 110.

E. Knob.

As shown in the figures, the present invention includes a knob 120 which actuates the dispensing assembly to dispense objects 86 through the upper opening 114 of the plate member 110 and into the cavity 97 of the base 90. While the term "knob" is used throughout the present application, it is submitted that a wide range of structures and devices could be utilized to actuate the dispensing assembly, including push-buttons, levers and the like. Thus, the scope of the present invention should not be construed as being limited to a circular knob 120 as is shown for exemplary purposes in the figures.

The knob 120 includes an upper end 121 and a lower end 122. The upper end 121 extends upwardly through the knob opening 117 of the plate member 110 and includes a trigger 123 extending therefrom, the trigger 123 being comprised of any structure which aids in turning the knob 120.

The lower end 122 of the knob 120 extends downwardly through the knob opening 117 of the plate member 110. The lower end 122 of the knob 120 includes a first lever anchor 125 and a second lever anchor 126 which are each comprised projections or other structures which act as anchors for the first and second levers 130, 134 of the present invention as described below.

The lower end 122 of the knob 120 further includes a spring anchor 127 to which a first end of a spring 128 will be connected, with the second end of the spring 128 being secured to the spring mount 119 of the plate member 110. The spring 128 is utilized to ensure that the knob 120 always returns to a rested position absent outside force.

Figure 3A:
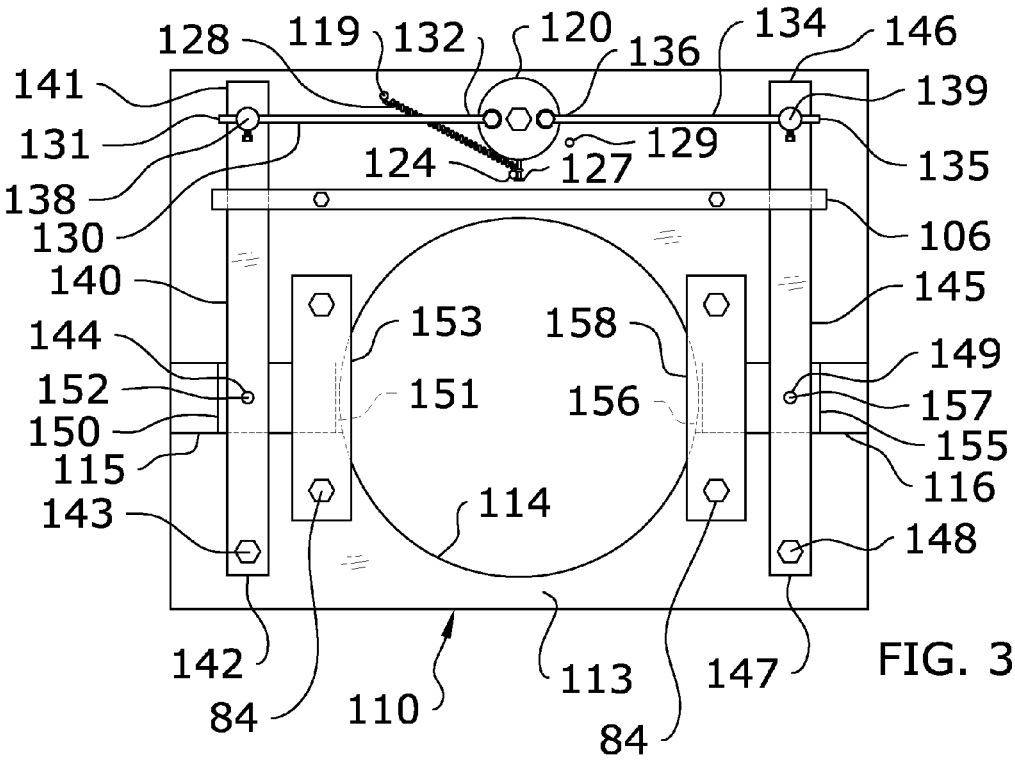
FIG. 3*a* is a first lower view of the plate member of a main embodiment of the present invention in resting position.
Figure 3B:
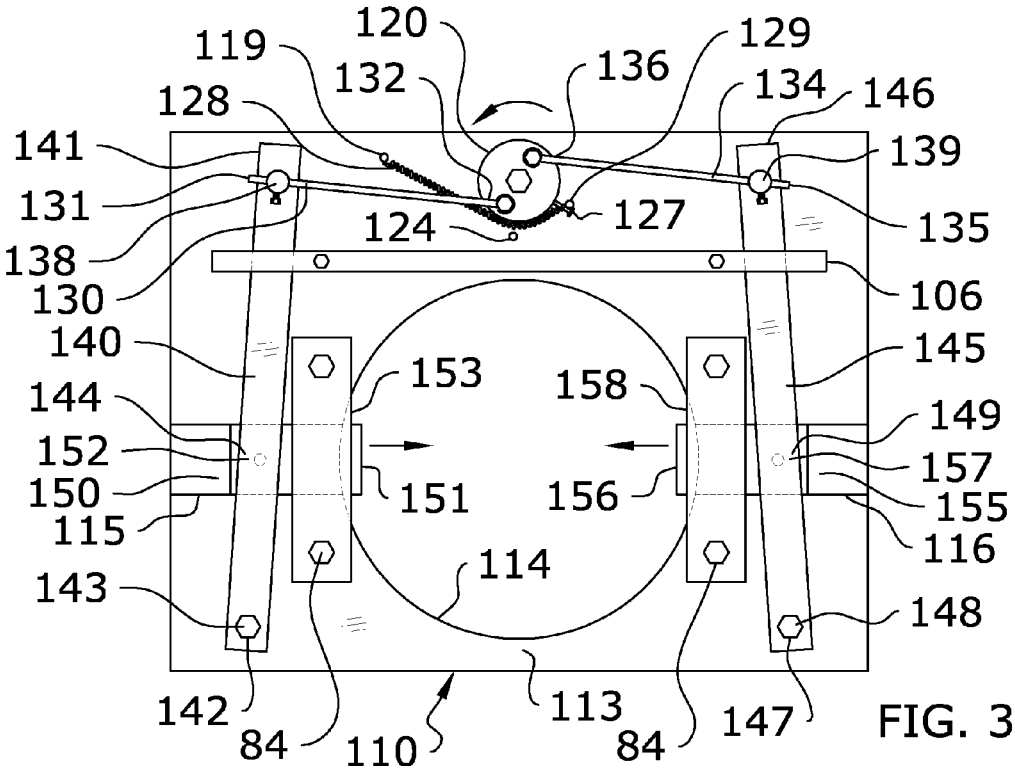
FIG. 3*b* is a second lower view of the plate member of a main embodiment of the present invention in activated position.
Figure 4:
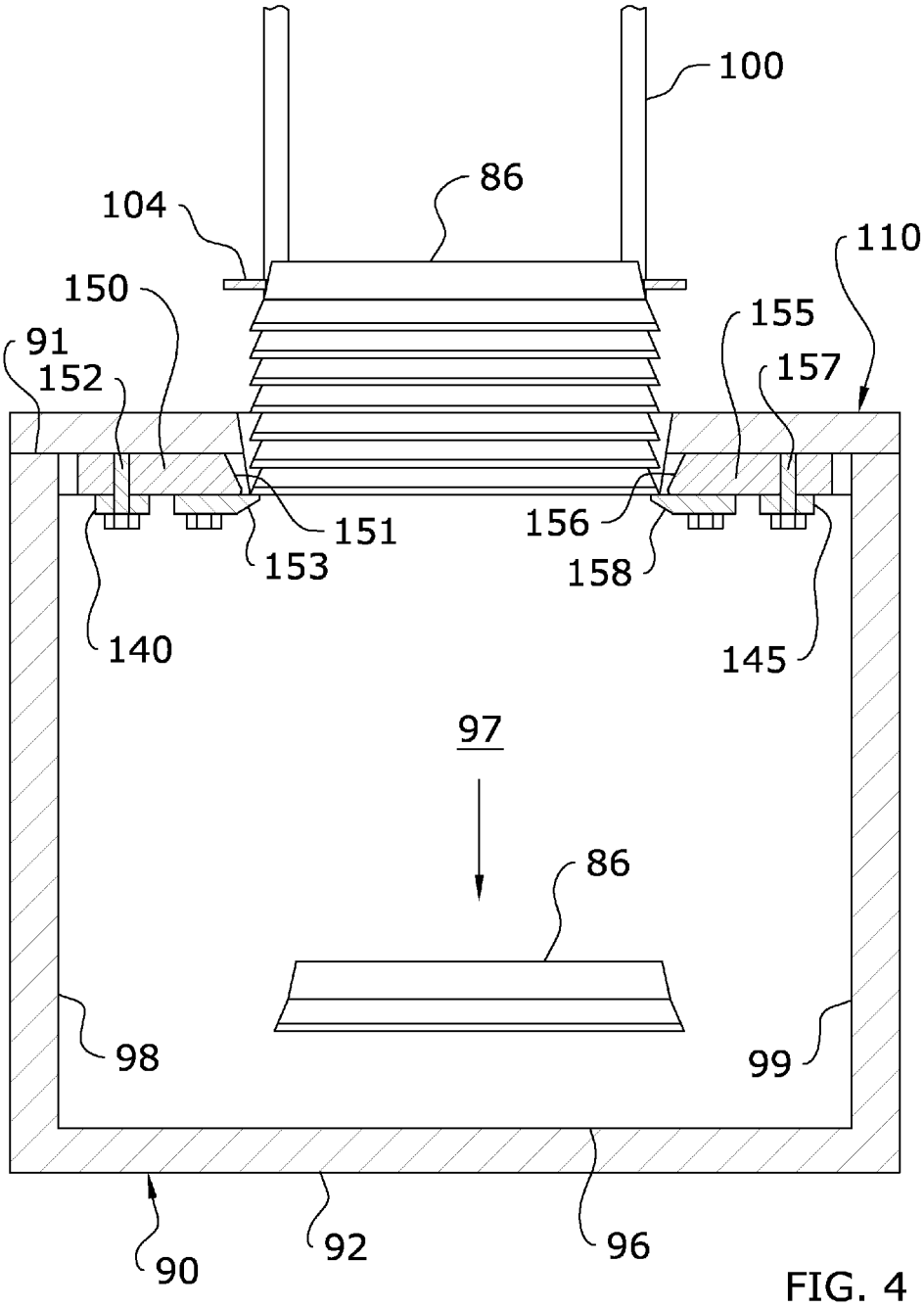
FIG. 4 is a frontal sectional view of a main embodiment of the present invention dispensing a lid.
Figure 5:
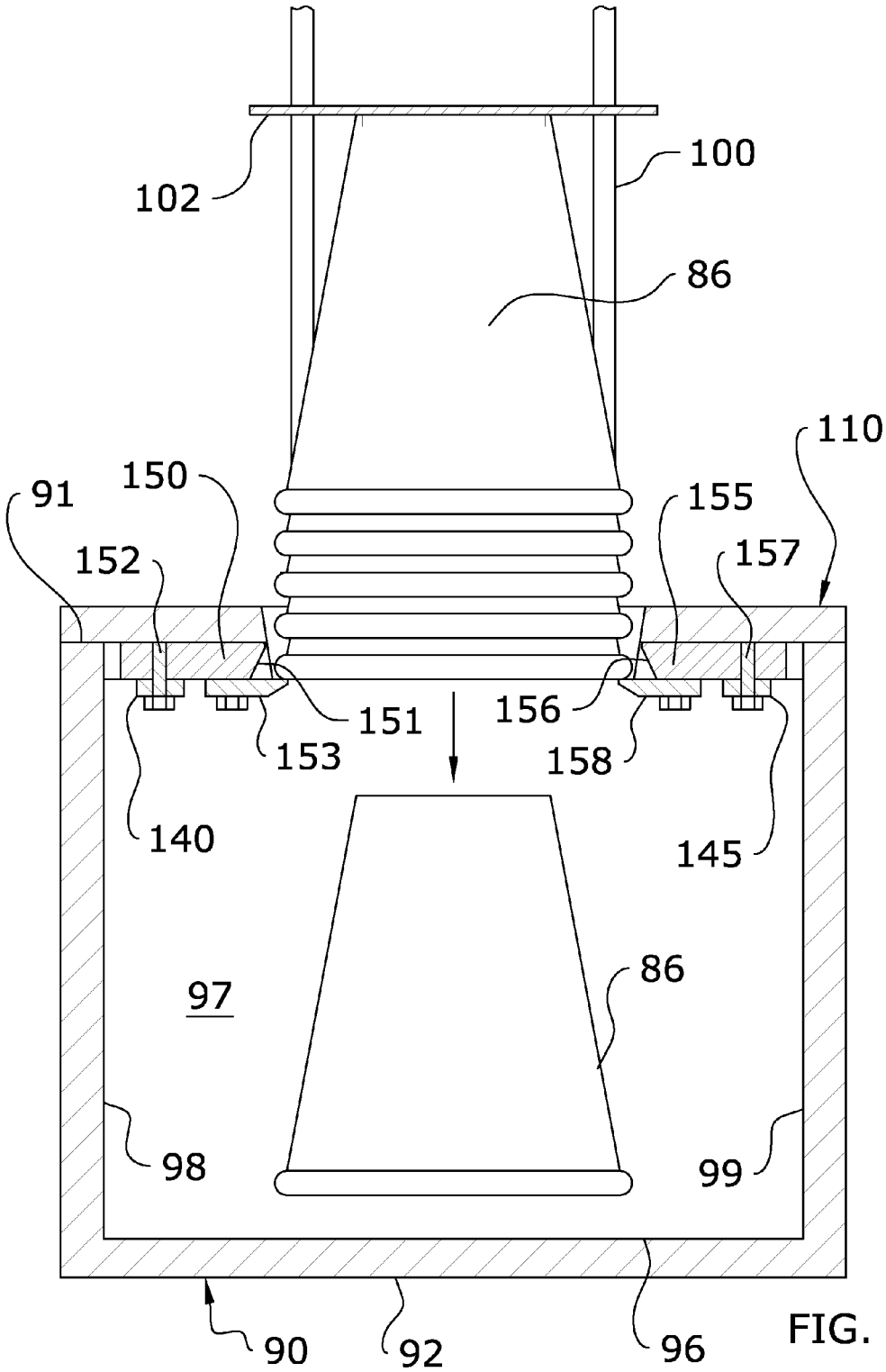
FIG. 5 is a frontal sectional view of a main embodiment of the present invention dispensing a cup.
Figure 6:
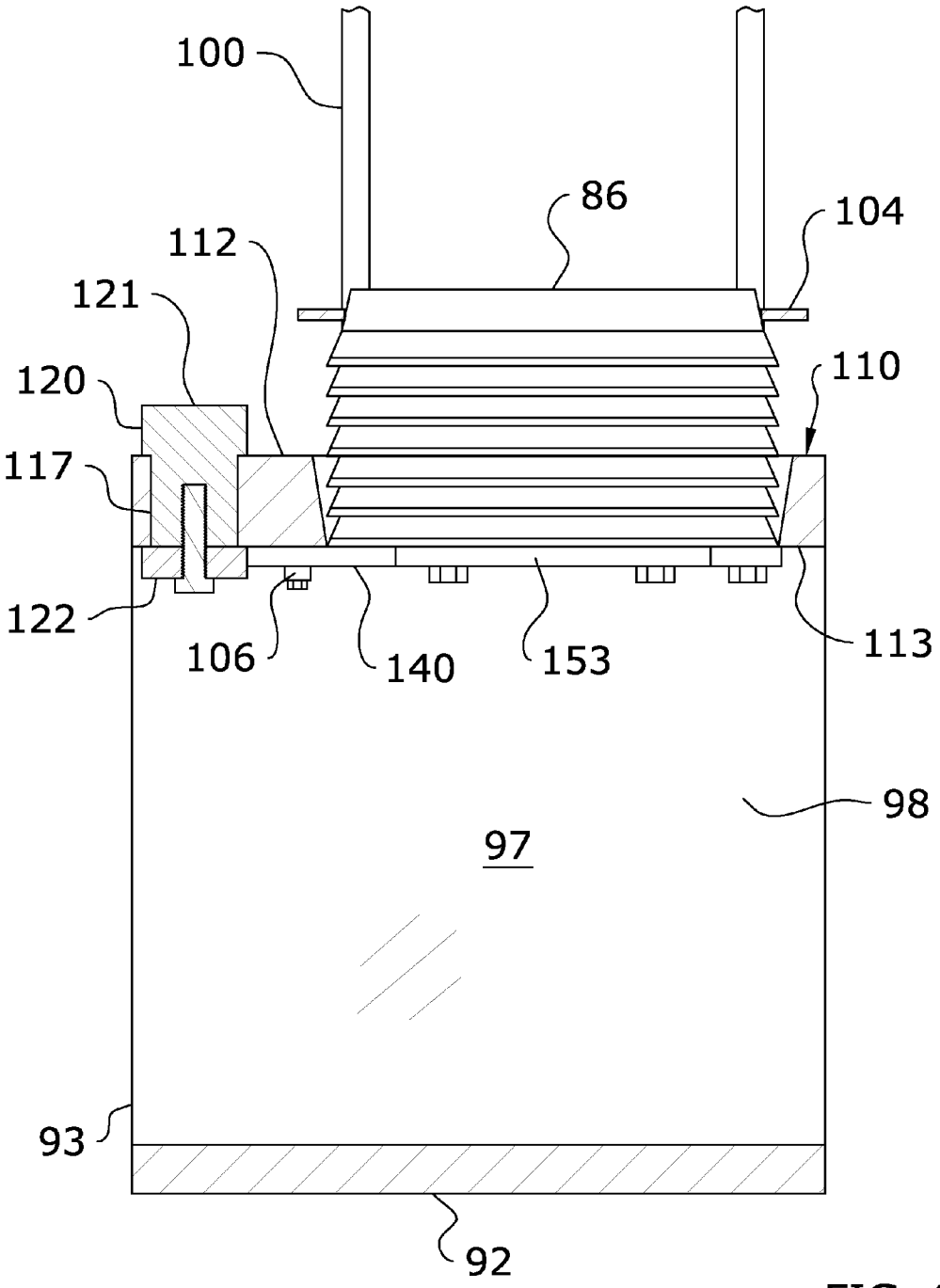
FIG. 6 is a side sectional view of a main embodiment of the present invention holding a stack of lids.

As best shown in FIGS. 3*a* and 3*b*, a pair of stoppers 124, 129 may be positioned adjacent said knob 120 to limit full rotation thereof. The spring anchor 127 of the knob 120 will contact said stoppers 124, 129 to prevent full rotation of the knob 120. Preferably, a first stopper 124 will be positioned directly underneath said knob 120 and a second stopper 129 will be positioned a radial distance therefrom. The stoppers 124, 129 may be comprised of various structures, but will preferably be comprised of peg-like structures extending from the lower end 113 of the plate member 110.

F. Dispensing Assembly.

The dispensing assembly of the present invention includes all of the components which are utilized to squeeze, push down and dispense the objects 86 through the opening 114 of the plate member 110. The dispensing assembly includes a first lever 130 having a first end 131 secured to a first end 141 of a first rail 140 and a second lever 134 having a first end 135 secured to a first end 146 of a second rail 145 as shown in FIGS. 2, 3*a* and 3*b*. The second ends 132, 136 of the levers 130, 134 each include a loop 133, 137 which interconnects with the respective lever anchor 125, 126 on the lower end 122 of the knob 120. The levers 130, 134 are utilized to impart turning force from the knob 120 to cause the rails 140, 145 to pivot as described herein.

The present invention includes a first rail 140 and second rail 145, each extending perpendicularly with respect to the levers 130, 134. The rails 140, 145 are adapted to pivot at their second ends 142, 147 which causes the dispensing members 150, 155 to advance toward the center of the opening 114, thus squeezing in and out the objects 86 to be dispensed.

The first rail 140 includes a first end 141 having a first lever peg 138 to which the first end 131 of the first lever 130 will be secured. The second end 142 of the first rail 140 includes a first pivot pin 143 extending therethrough such that the second end 142 of the first rail 140 is pivotally secured to the lower end 113 of the plate member 110 as shown in the figures. The first rail 140 also includes a first dispenser aperture 144 extending therethrough through which the first peg 152 of the first dispensing member 150 will be inserted.

The second rail 145 includes a first end 146 having a second lever peg 139 to which the first end 135 of the second lever 134 will be secured. The second end 147 of the second rail 145 includes a second pivot pin 148 extending therethrough such that the second end 147 of the second rail 145 is pivotally secured to the lower end 113 of the plate member 110 as shown in the figures. The second rail 145 also includes a second dispenser aperture 149 extending therethrough through which the second peg 157 of the second dispensing member 155 will be inserted.

A rail retainer 106 is also provided which extends over the floating ends 141, 146 of the rails 140, 145 as shown in FIGS. 3*a* and 3*b*. The rail retainer 106 acts to retain the rails 140, 145 against the plate member 110 and thus not fall loose. The rail retainer 106 should be extended over the rails 140, 145 such that the rails 140, 145 are capable of freely sliding thereunder.

The pivoting action of the rails 140, 145 acts to push in and withdraw one or more dispensing members 150, 155 toward/away from the center of the opening 114 of the plate member 110. While varying numbers of dispensing members 150, 155 may be utilized, a preferred embodiment utilizes a first dispensing member 150 which is slidably secured within the first slot 115 of the plate member 110 and a second dispensing member 155 which is slidably secured within the second slot 116 of the plate member 110.

The first and second dispensing members 150, 155 are each generally comprised of a rectangular member having a tapered front edge 151, 156. The tapering on the front edges 151, 156 aids with pushing the object 86 down to be dispensed while it is being squeezed by the dispensing members 150, 155. The dispensing members 150, 155 each include a peg 152, 157 extending upwardly therefrom which is utilized to secure the respective rails 140, 145 to each dispensing member 150, 155 utilizing the rails' 140, 145 respective dispenser apertures 144, 149. A first dispensing retainer 153 comprised of a bar extending perpendicular to the first dispensing member 150 is positioned over the first dispensing member 150 to secure it within the slot 115 in a manner which allows the dispensing member 150 to slide thereunder. A second dispensing retainer 158 is also provided for the second dispensing member 155 as shown in the figures.

G. Operation of Main Embodiment.

In use, the objects 86 to be dispensed, such as cups or lids, are first stacked within the retention member 100. They are retained within the opening 114 by the dispensing retainers 153, 158, which each slightly abut into the opening 114 as shown in the figures.

Upon turning of the knob 120, the respective levers 130, 134 will impart turning force to pivot the rails 140, 145. The pivoting motion of the rails 140, 145 causes the dispensing members 150, 155 to push inward, thus squeezing the object 86 to be of less diameter than that of the width between the abutted portions of the dispensing retainers 153, 158. The tapered front edges 151, 156 of the dispensing members 150, 155 also aids with pushing the object 86 downward. Since only the lowest of the stack of objects 86 is squeezed and pushed down, the remaining objects 86 are not dispensed until the knob 120 is turned again. Releasing the knob 120 will return it to its rested position absent application of additional force to dispense additional objects 86.

Figure 7:
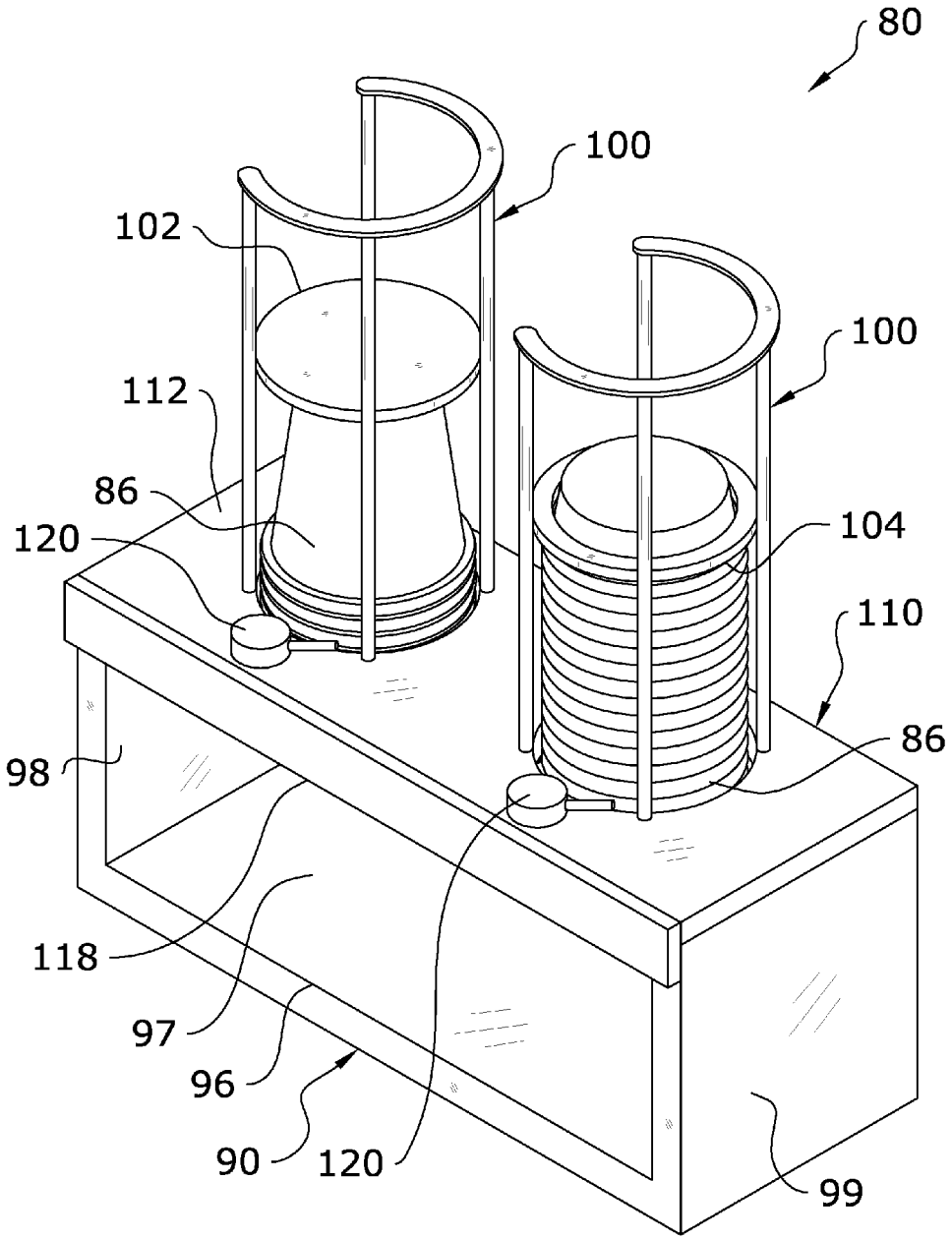
FIG. 7 is an upper perspective view of an alternate version of a main embodiment of the present invention.

FIG. 7 also illustrates a second version of the main embodiment of the present invention. This version includes everything duplicated side-by-side such that a first retention member 100 may support a stack of a first object 86, such as cups, and the second retention member 100 may support a stack of a second object 86, such as lids.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A stackable object dispenser, comprising:

a base, said base including a frontal opening and an upper end;

a plate member positioned on said base, said plate member including an upper opening, wherein said upper opening and said frontal opening lead to an internal cavity formed within said base;

a retention member extending from said upper end of said base, said retention member being adapted to store a plurality of stacked objects therein, wherein said retention member is positioned over said upper opening;

a knob extending through said plate member, wherein said knob includes a spring anchor and wherein said plate member includes a spring mount;

a spring extending between said spring mount and said spring anchor;

a first lever connecting said knob with a first rail, wherein a lower end of said first rail is pivotally secured to said plate member;

a second lever connecting said knob to a second rail, wherein a lower end of said second rail is pivotally secured to said plate member;

a rail retainer extending over said first rail and said second rail;

a first dispensing member secured to said first rail;

a second dispensing member secured to said second rail, wherein said first dispensing member and said second dispensing member are each adapted to slide toward said upper opening in response to activation of said knob to dispense one of said plurality of stacked objects through said upper opening;

a first dispensing retainer positioned over said first dispensing member and a second dispensing retainer positioned over said second dispensing member.

2. The stackable object dispenser of claim 1, wherein said plate member and said base are integrally formed of a unitary structure.

3. The stackable object dispenser of claim 1, further comprising a stabilizer member adapted to be positioned on top of said plurality of stacked objects to stabilize said plurality of stacked objects within said retention member.

* * * * *